United States Patent [19]

Young

[11] 4,067,800

[45] Jan. 10, 1978

[54] SCREENING APPARATUS

[75] Inventor: Douglas L. Young, Lennoxville, Canada

[73] Assignee: Ingersoll-Rand Company, Woodcliff Lake, N.J.

[21] Appl. No.: 747,952

[22] Filed: Dec. 6, 1976

[51] Int. Cl.[2] ..... B07B 1/20

[52] U.S. Cl. ..... 209/273; 209/306

[58] Field of Search ..... 209/273, 47, 306, 309, 209/380, 389; 162/55, 341

[56] References Cited

U.S. PATENT DOCUMENTS

| | | | |
|---|---|---|---|
| 3,420,373 | 1/1969 | Hunter | 209/306 |
| 3,437,204 | 4/1969 | Clarke-Pounder | 209/273 |
| 3,533,505 | 10/1970 | Nelson | 209/273 |
| 3,933,649 | 1/1976 | Ahlfors | 209/273 |

*Primary Examiner*—Frank W. Lutter
*Assistant Examiner*—Jon Hokanson
*Attorney, Agent, or Firm*—Frank S. Troidl

[57] ABSTRACT

The pressurized screening apparatus for screening fibrous material in liquid suspensions includes a fixed cylindrical screen mounted within a housing to form an inner chamber. An axially extending annular channel receives the suspension. A dilution liquid is passed tangentially into the channel. The dilution liquid helps in the separation of the acceptable fibers from the undesired constituent so that a large proportion of the acceptable fibers is fed through the cylindrical screen and a minimal amount of undesired material flows to the bottom of the annular channel as part of the rejects.

6 Claims, 3 Drawing Figures

SCREENING APPARATUS

This invention relates to pressure-operated apparatus for screening fibrous material suspended in liquid, such as wood pulp suspensions and the like.

Typically, in the preparation of pulp from wood, the wood chips may be fed to a digester. Various physical actions and chemical reactions take place within the digester to remove lignin, leaving the desired cellulose fibers. The cooked pulp is then screened and fed to a brown stock washer.

The pulp from the digester normally contains partially cooked chips and knots which cannot be allowed to proceed further in the process. The pulp may also contain many other contaminants such as particles of metal, glass, plastic materials including solid and foam plastic and other substances, all of which should be removed.

To remove this unacceptable debris, screening system apparatuses called "knotters" have been placed in the pulp processing system between the digester and the brown stock washer. The knotters remove the undesired coarse material from the process flow and feed only the acceptable fibers to the brown stock washer. The unacceptable material rejected by the knotter system may be recirculated back to the digester for recooking or otherwise disposed of.

A conventional knotter system comprises primary and secondary stages, both of which may feed accepts to the washers. Conventional primary knotter screens, especially of the pressurized type, tend to reject excessive amounts of fiber with the knots, necessitating the use of secondary screens to recover fiber from the primary screen rejects.

An important advantage of pressurization of the knotter screen system is to eliminate the entrainment of air in the liquor. An entrainment results in lower efficiency and lower capacity of the washers, greater chemical losses with attendant higher costs, and in foam generation which adversely affects the entire screening and washing operations.

Conventional pressurized knotters involve considerable fiber loss in the rejects flow stream, such that vibratory secondary screens are frequently used to finally separate the knots and other contaminants from the good fiber. In this case, aeration still occurs in the secondary stage and the potential benefits of pressurized screening are not attained.

Thus, an important feature of this invention is that when used on knotter service as the primary screen stage, the proportion of fiber rejected shall be considerably less than from conventional screens thereby (a) permitting the use of a second stage pressurized screen similar to the primary stage, which is able to provide system rejects at a satisfactory low fiber content, (b) permitting the use of alternative substantially non-aerating forms of secondary screen, such as submerged screw drainers, which may be impractical for high fiber flows, or (c) reducing disadvantageous aeration if secondary vibratory screws should still be preferred.

A currently used pressurized screening apparatus is disclosed by U.S. Pat. No. 3,533,505 granted Oct. 13, 1970 to George Larsen Nelson entitled "Screening Apparatus." However, the screening apparatus shown in this patent, among other things, rejects too much good fiber.

This invention reduces the amount of fiber rejected per stage of screening.

An ideal screening apparatus can be fed a pulp suspension which has all kinds of contaminants, such as sand, stones, metal and so forth, and in a single line single stage screening operation, separate substantially all the desired materials from the mixture. This invention provides the screening art with a screening apparatus that closely approaches the ideal system.

Briefly described, a fixed cylindrical screen is mounted within the housing to form an inner chamber. An axially extending annular channel is provided around the fixed cylindrical screen. A dilution liquid is passed into the annular channel. The dilution liquid has a tangential velocity component. The fibrous material in liquid suspension is fed into the annular channel. The desired materials, which have passed through the cylindrical screen and into the inner chamber are discharged from the accepts outlet; the undesired material which does not pass through the cylindrical screen is fed directly from the annular channel to the rejects outlet. The reject flow contains only a very small proportion of material acceptable by the screen perforations.

The invention, as well as its many advantages, will be further understood by reference to the following detailed description and drawings in which.

Like parts are referred to by like numbers in the various figures.

Figure 1:
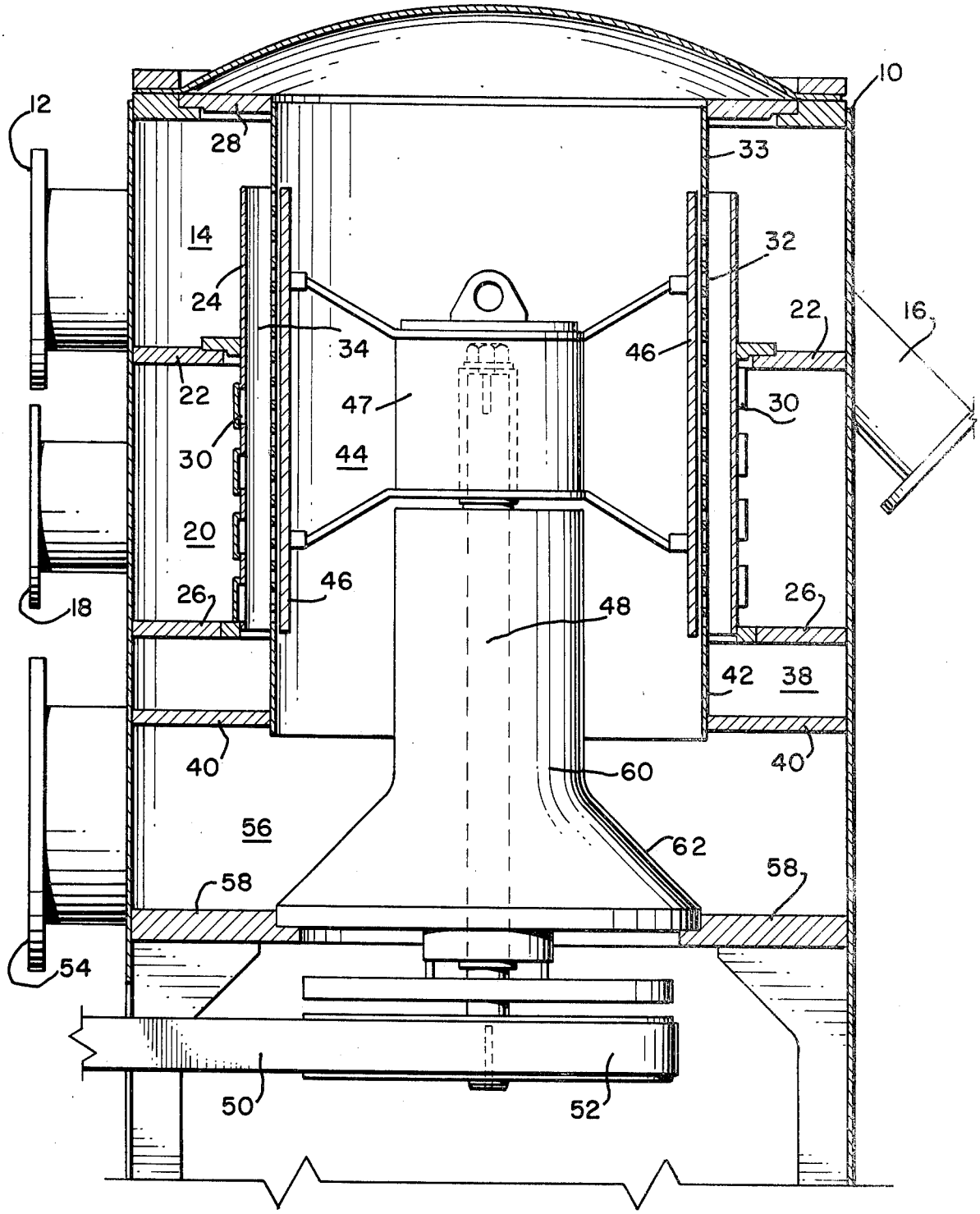
FIG. 1 is an elevational view, partly in section, illustrating a preferred embodiment of the invention.
Figure 2:
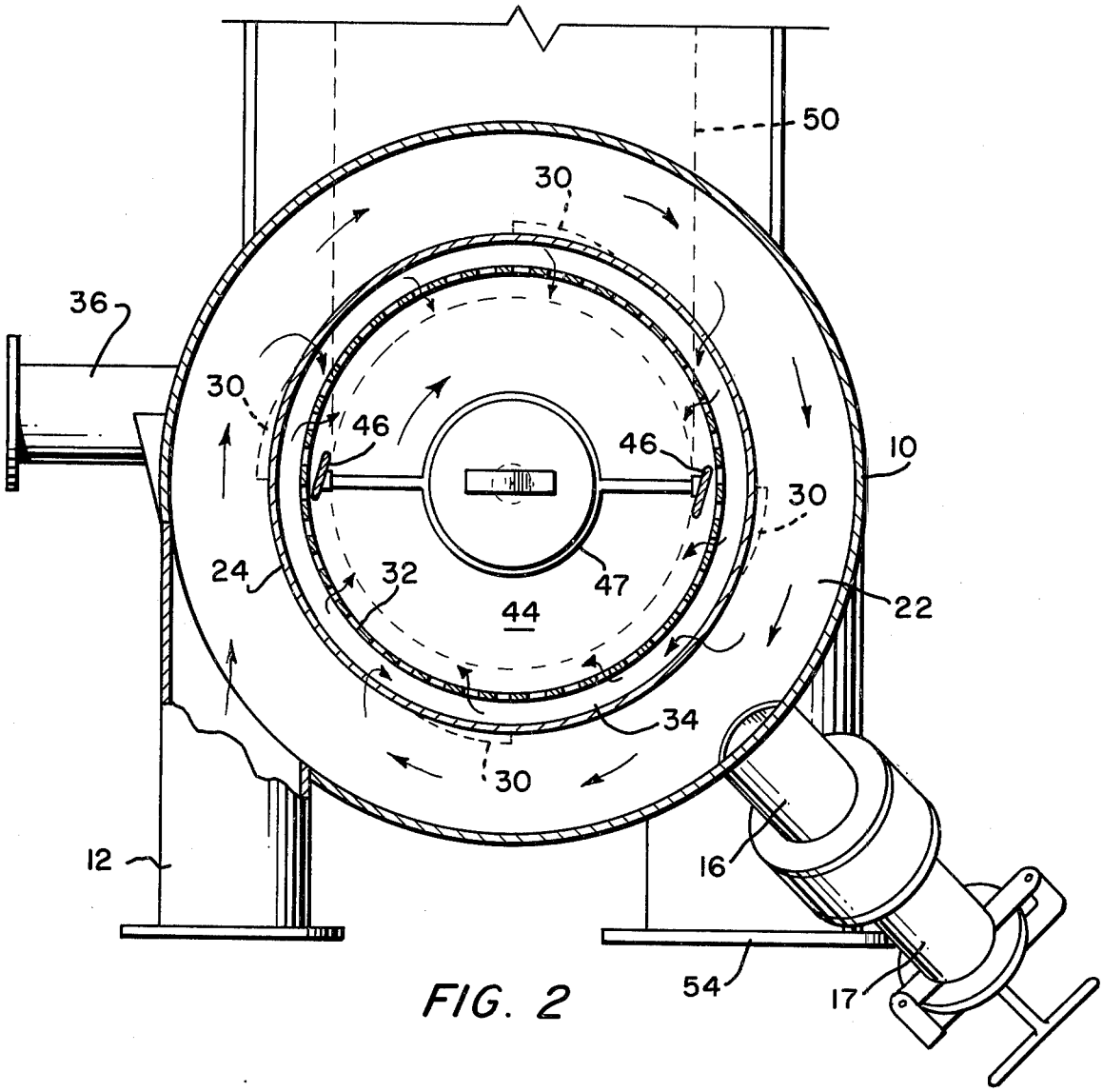
FIG. 2 is a top view, partly in section, of the embodiment shown in FIG. 1.
Figure 3:
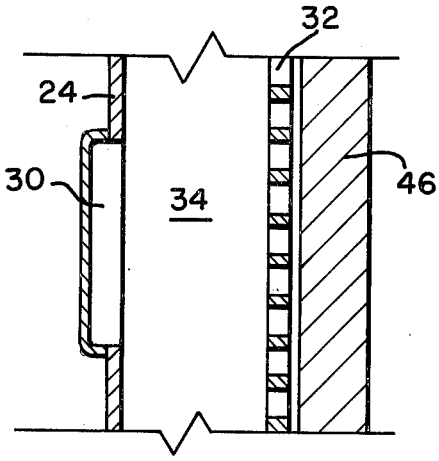
FIG. 3 is a sectional view on an enlarged scale illustrating an important part of the invention.

Referring to the drawings, and more particularly to FIG. 1, the new screening apparatus includes a housing 10, which is provided with a wood pulp suspension inlet 12. An annular suspension receiving chamber 14 receives the suspension fed into the housing 10 through the wood pulp suspension inlet 12. A first housing outlet 16 extends angularly from the bottom of the annular chamber 14. Housing outlet 16 is connected to trap 17 (see FIG. 2) for stones or other very large, undesired debris which might be included in the suspension. The debris collected in trap 17 may be removed intermittently during operation of the machine.

A dilution liquid inlet 18 is located below the suspension inlet 12. Dilution liquid fed into housing 10 through inlet 18, goes into an annular dilution liquid chamber 20, located within the housing 10, and separated from the pulp suspension inlet chamber 14 by an annular partition 22.

A fixed unperforated cylindrical wall 24 extends from the inside periphery of the bottom partition 26 of the dilution liquid chamber 20, to a point spaced below the top 28 of the annular suspension-receiving chamber 14. The cylindrical wall 24 forms the inside wall of the annular dilution liquid chamber 20 and also forms an inside wall of the annular pulp suspension inlet chamber 14. That portion of the cylindrical wall 24 located in the annular suspension-receiving chamber 14 serves as a baffle to force the pulp to flow over the top of the cylindrical wall 24. The large particles, such as stone, gravel, glass, metal pieces, or other heavy impurities will be too heavy to flow over the top of the wall 24, and thus by centrifugal separation will flow to the outlet 16, and be removed from the housing 10.

That portion of the cylindrical wall 24 which forms the inside wall of the annular dilution liquid chamber 20 is provided with a plurality of spaced dilution liquid ports 30 transversely spaced from and opposite to perforations in the screen 32. In the preferred embodiment shown, there are four sets of spaced ports 30 separated circumferentially approximately 90° (see FIG. 2). The number of sets of ports and the number of ports in each set may vary. Under some pulp processing conditions only one large dilution liquid opening may be provided in cylindrical wall 24.

The fixed cylindrical screen 32 is mounted within the housing 10 coaxially with the cylindrical wall 24, but has a smaller radius than the radius of the cylindrical wall 24 to thereby provide an annular conduit or channel 34, defined by the outside of the screen 32, and the inside of the cylindrical wall 24. The top part 33 of the cylindrical screen 32 is preferably unperforated so material flowing over the baffle is forced to flow into annular conduit 34.

A rejects outlet 36 (see FIG. 2) is in fluid communication with the annular conduit 34 through annular rejects chamber 38. The annular rejects chamber 38 is defined by a portion of the inside of the housing 10, the annular partition 26, the annular partition 40, and the cylindrical preferably unperforated lower portion 42 of the fixed cylindrical screen 32.

An inner chamber 44 is formed by the cylindrical screen 32. Rotatable foil means including a pair of hydrofoils 46, circumferentially separated by an approximate 180° arc is coaxial with the screen. The hydrofoils are mounted upon a rotor 47 which rotates with rotatable shaft 48, which is driven preferably by a motor driven belt 50 extending around a pully 52 connected to the bottom of the rotatable shaft 48.

The accepts outlet 54 is in fluid communication with the inner chamber 44 through an annular accepts chamber 56 formed by a portion of the vertical wall of housing 10, the annular partition 40, the annular partition 58, and the center column 60. Column 60 extends upwardly in the center of the housing 10, and surrounds the rotatable shaft 48. The bottom portion 62 of the stationary column 60 is tapered facilitating the flow of the desired constituents into the annular chamber 56 and out of the housing 10 through accepts outlet 54.

The various inlets and outlets to the housing 10 might be at any desired circumferential location, provided the inlets lead into the proper annular chambers and the outlets lead from the proper annular chambers. For example, the wood pulp suspension inlet 12 can lead into the annular suspension inlet chamber 14 at any circumferential position, and the stone trap or outlet 16 may lead from the wood pulp suspension inlet annular chamber 14 at any circumferential position provided the outlet 16 is located near the base or bottom annular wall 22 of the wood pulp suspension inlet annular chamber 14. Likewise, the dilution liquid inlet 18 may lead into the dilution liquid chamber 20 at any circumferential position on the housing 10. The rejects outlet 36 may lead from rejects annular chamber 38 at any circumferential position on the housing 10, and the accepts outlet 54 may lead from the annular chamber 56 at any circumferential position on the housing 10.

In operation, the wood pulp suspension is conducted through inlet 12 into the annular suspension inlet chamber 14. The heavier undesired material and impurities such as stones and pieces of metal, in particular, are too heavy to flow over the annular baffle formed by the top part of the cylindrical wall 24. Such contaminants are removed by gravity from the housing 10 through the outlet 16 to stone trap 17.

A very important part of this invention is the provision of the means for flowing the dilution liquid into the channel 34 with a tangential velocity component, preferably in the same direction as the flow direction of the wood pulp suspension. The objective of screen separating is to obtain a maximum amount of acceptable fibers in the accepts outlet and to minimize the amount of acceptable fibers which fail to go through the screen. I have found that when the dilution liquid is fed through the dilution liquid ports 30, tangentially into the channel 34, the axial velocity distribution in channel 34 is changed such that a large percentage of rejects flow travels axially adjacent cylindrical wall 24 with lower axial flow velocity adjacent the screen 32. Thus the fibers in the suspension tend to be accepted through the screen and the rejects portion containing largely dilution liquid and particles too large to pass through the screen are discharged from the rejects outlet. Thus, a very large amount of contaminants fall along the inside of the cylindrical wall 24 into the rejects chamber 38 and the amount of acceptable fiber sifted through the screen 32 is maximized.

The desired fibers flow through the perforations in cylindrical screen 32 into the inner chamber 44, downwardly into the annular accepts chamber 56, and out of the accepts outlet 54.

The hydrofoils 46 rotate within the inner chamber 44 with a small radial clearance between the outsides of the blades and the inside of the screen 32. The rotation of the hydrofoils 46 within the inner chamber 44 along a path close to the inside of the screen 32 develops hydrodynamic flow pulses directed radially outwardly and operable to dislodge accumulated unwanted material from the outside of the screen 32.

Preferably the radial dimension of annular channel 34 is kept small enough so that the acceptable fiber content in the rejects is kept to a minimum and a reasonably low reject flow is maintained. If the radial dimension of annular channel 34 is too large, the acceptable fiber concentration in the rejects becomes too high and the total reject fiber content becomes too large. A channel 34 radial dimension of four inches or less is preferred for most uses of this new invention.

When this invention is used as a knotter, the holes in screen 32 may have a minimum dimension of ¼ inch. However, this invention may also be used as a fine screen apparatus such as used in screening paper making pulps. In such case, the screen 32 may have holes with a minimum dimension of around 1/16 inch diameter or slots of minimum width around 0.020 inches.

I claim:

1. In a pressurized screening apparatus for screening a liquid suspension containing desirable fiber and undesirable contaminants comprising: a fixed enclosing screen having an axial perforated section extending around its periphery and forming an accepts chamber; an accepts outlet communicating with the accepts chamber; a fixed cylindrical wall surrounding the enclosing screen to form an axially extending channel defined by the outside of the screen and said wall, said axially extending channel having a radial dimension small enough so that the acceptable fiber content in the rejects is kept to a minimum and a reasonably low reject flow is maintained; means for flowing dilution liquid defined by said wall, having a tangential velocity component, into the axially extending channel, at at least one point transversely spaced from and opposite to perforations in the enclosing screen; means for flowing at least part of the liquid suspension into the axially extending channel at a point axially spaced from all the perforations in the enclosing screen; and a rejects outlet communicating with the axially extending channel for removing undesirable contaminants from the housing.

2. A pressurized screening apparatus in accordance with claim 1 wherein the means for flowing dilution liquid having a tangential velocity component into the axially extending channel are a plurality of vertically spaced dilution liquid ports.

3. A pressurized screening apparatus for screening a liquid suspension containing desirable fiber and undesirable contaminants comprising: a closed housing; a fixed cylindrical screen mounted within the housing and forming an inner chamber; an accepts outlet communicating with the inner chamber formed by the cylindrical screen for passing the acceptable fibers from the housing; a fixed unperforated cylindrical wall concentrically mounted within the housing and having a larger radius than the radius of the cylindrical screen to thereby form an axially extending annular channel defined by the outside of the screen and the inside of the cylindrical wall said axially extending channel having a radial dimension small enough so that the acceptable fiber content in the rejects is kept to a minimum and reasonably low reject flow is maintained; means for flowing dilution liquid having a tangential velocity component through at least one port in said cylindrical wall and into said annular channel at at least one point transversely spaced from and opposite to perforations in the enclosing screen; means for flowing the liquid suspension into the annular channel formed by the cylindrical screen and the cylindrical wall; and a rejects outlet communicating with the annular channel for removing undesirable contaminants from the housing.

4. An apparatus in accordance with claim 3 wherein the means for tangentially flowing dilution liquid through the cylindrical wall and into the annular channel comprises: a dilution liquid inlet; a dilution liquid chamber for receiving the liquid from the dilution liquid inlet, and a plurality of spaced dilution liquid ports in the cylindrical wall, said ports interconnecting the dilution liquid chamber and the annular channel defined by the screen and the cylindrical wall.

5. A pressurized screening apparatus for screening a liquid suspension containing desirable fiber and undesirable contaminants comprising: a closed housing having a suspension inlet; an annular suspension receiving chamber for receiving suspension fed into the housing through the suspension inlet; a first housing outlet extending from the annular suspension receiving chamber for removal of large undesired debris from the suspension; a dilution liquid inlet for feeding dilution liquid into the housing, an annular dilution liquid chamber located within said housing and below the annular suspension receiving chamber; a fixed unperforated cylindrical wall forming the inside wall of the annular dilution liquid chamber, said cylindrical wall extending to a point spaced from the top of the annular suspension receiving chamber so that the cylindrical wall also forms a baffle to force the suspension from the annular suspension receiving chamber to flow over the top of the cylindrical wall; that portion of the cylindrical wall forming the inside wall of the annular dilution liquid chamber being provided with at least one dilution liquid port; a fixed cylindrical screen coaxial with the cylindrical wall but having a smaller radius than the radius of the cylindrical wall to thereby provide an annular conduit defined by the outside of the screen and the inside of the cylindrical wall for receiving the suspension which flows over the top of the baffle, the dilution liquid port being constructed to flow the dilution liquid tangentially into the annular conduit at a point transversely spaced from and opposite to perforations in the screen; a rejects outlet, said rejects outlet being in communication with the annular conduit whereby undesirable contaminants are removed from the rejects outlet; rotatable foil means coaxial with the fixed cylindrical screen comprising circumferentially spaced hydrofoils extending along the inside of the screen so that upon rotation of the hydrofoils the fibers and contaminants are prevented from clogging the holes in the screen; means for rotating the hydrofoils; and an accepts outlet in communication with the inside of the cylindrical screen for the removal of the accepted material from the housing.

6. A pressurized screening apparatus for screening a liquid suspension containing desirable fiber and undesirable contaminants comprising: a closed housing having at least one inlet; a fixed cylindrical screen mounted within the housing and forming an inner chamber; foil means concentrically rotatably carried within said inner chamber and adjacent the inside of the fixed cylindrical screen for preventing clogging of the screen; drive means for driving said foil means; an accepts outlet communicating with the inner chamber formed by the cylindrical screen for passing desirable fiber from the housing; a fixed unperforated cylindrical wall concentrically mounted within the housing and having a larger radius than the radius of the cylindrical screen to thereby form an axially extending annular channel defined by the outside of the screen and the inside of the cylindrical wall said annular channel having a radial dimension of no more than 4 inches; means for tangentially flowing dilution liquid through said cylindrical wall and into said annular channel at points transversely spaced from and opposite to perforations in the cylindrical screen; means for flowing liquid suspension from said inlet into the annular channel formed by the cylindrical screen and the cylindrical wall; and a rejects outlet communicating with the annular channel for removing undesirable contaminants from the housing.

* * * * *